US006857974B2

(12) United States Patent
Noda

(10) Patent No.: US 6,857,974 B2
(45) Date of Patent: Feb. 22, 2005

(54) REPAIR TOOL FOR DEPRESSION IN PUTTING GREEN ON GOLF COURSE

(76) Inventor: Takao Noda, 669-10, Kannami-machi Nitta, Tagata-gun, Shizuoka-ken 419-0114 (JP)

( * ) Notice: Subject to any disclaimer, the term of this patent is extended or adjusted under 35 U.S.C. 154(b) by 25 days.

(21) Appl. No.: 10/687,769

(22) Filed: Oct. 20, 2003

(65) Prior Publication Data

US 2004/0082410 A1 Apr. 29, 2004

(30) Foreign Application Priority Data

Oct. 28, 2002 (JP) ..... 2002-311995

(51) Int. Cl.[7] ..... A63B 69/36
(52) U.S. Cl. ..... 473/408
(58) Field of Search ..... 473/408; 172/371, 172/372, 375; 56/400.17, 400.18

(56) References Cited

U.S. PATENT DOCUMENTS 3,168,150 A * 2/1965 Kappler ..... 172/371
3,567,264 A * 3/1971 Baber ..... 172/371
4,483,133 A * 11/1984 Pasley ..... 56/400.17
4,843,667 A * 7/1989 Hanly, Sr. ..... 56/400.19
5,730,226 A * 3/1998 Kendall ..... 172/378
6,062,992 A * 5/2000 Hoyt et al. ..... 473/408

* cited by examiner

*Primary Examiner*—Steven Wong
(74) *Attorney, Agent, or Firm*—Wenderoth, Lind & Ponack, L.L.P.

(57) ABSTRACT

A repair tool for a depression formed in a putting green enables a golfer responsible for the repair of the depression to gather the earth surrounding the depression easily toward the center of the depression by using the tool just once and even enables the golfer to perform the repair while continuously standing without doing any harm to the roots of the turf grasses. In this repair tool, split projecting pieces 9 which are so disposed as to encompass the outer periphery of a depression D in a putting green and made to form inserting claw parts 10 on the lower terminal side thereof and tapered parts 11 on the outer wall side thereof are extended downward from the lower side of a grip part through a rod and the grip part is provided with a slide engaging member 14 which is vertically moved relative to the tapered parts 11 by the manipulation of the grip part. By the vertical motion of this slide engaging member 14, the inserting claw parts 10 are enabled to be moved toward and away from the central part of the depression D in the putting green.

3 Claims, 3 Drawing Sheets

REPAIR TOOL FOR DEPRESSION IN PUTTING GREEN ON GOLF COURSE

BACKGROUND OF THE INVENTION

1. Field of the Invention

This invention relates to a repair tool for repairing a depression formed in a putting green by the use of a golf ball and more particularly to a repair tool for a depression in a putting green which repair tool enables the user thereof to repair easily the depression while continuously standing without doing any damage to the turf in a putting green.

2. Description of the Related Art

On a golf course, a golf ball shot by a golfer is fated to inflict a depression conforming with the contour of the ball on the putting green (hereinafter referred to "a depression in the putting green") and this depression in the putting green is supposed to be repaired by the player responsible for the depression during the course of the play. As the method for repairing the depression in the putting green, it has been heretofore customary for the golfer to do this repair by using the head of a hard club such as a putter or an iron or to effect the repair by manipulating a putting-green fork which is only a repair tool having a forked claw part formed at one end of a basal plate made of metal or resin.

When the repair is made with the head of a hard club, it is not easily achieved by a player who is not particularly accustomed to the work, because of the contributory factor that the club is not exclusively intended for the repair work. When the repair is effected with the putting-green fork, the user encounters the trouble of having to repeat the operation of inserting the fork in the periphery of the depression and pulling the earth toward the center of the depression. This operation does not permit the golfer to perform it while continuously standing during the whole course thereof. Moreover, the player who is not accustomed to the use of this fork is liable to insert the fork obliquely and possibly scoop up the earth and consequently cut roots of turf grasses and damage the turf.

SUMMARY OF THE INVENTION

In the light of this true state of affairs, the present invention has for an object thereof the provision of a repair tool for a depression in a putting green, which repair tool enables even an unaccustomed player having inflicted a depression with his golf ball on the putting green to gather the earth surrounding the depression toward the center thereof by using the tool just once and fulfill this repair easily while continuously standing without doing any harm to the roots of the turf grasses.

To fulfill the task imposed on this invention, the repair tool for a depression formed in a putting green contemplated by this invention as set forth in claim 1 comprises a grip part having an lower grip piece and an upper grip piece mounted expandably in the vertical direction through the medium of spring bodies, a plurality of split projecting pieces ramified downward through the medium of oblong split grooves from the basal terminal part of a rod vertically disposed downward from the lower grip piece of the grip part, the plurality of split projecting pieces being so disposed as to encompass the outer periphery of the depression in the putting green, the lower terminal sides of the split projecting pieces being so adapted as to serve as inserting claw parts capable of being inserted into the ground surface, tapered parts formed of the outer wall sides of the split projecting pieces above the positions of the inserting claw parts and adapted to impart a gradual radial expansion to the inclined surfaces thereof in the direction of decreasing height, the split projecting parts being endowed with elasticity such that the inserting claw parts on the lower terminal sides thereof are deformed inward when an external depressing force is applied to the tapered parts and they are allowed to resume their former shape when the depressing force is released, an annular slide engaging member formed at the lower terminal of a connecting rod vertically disposed downward from the upper grip piece of the grip part and adapted to contact uniformly the outer sides of the tapered parts and produce a free vertical motion, and the slide engaging member being vertically moved relative to the tapered parts and the inserting claw parts being moved toward and away from the central part of the depression in the putting green by pressing the lower grip piece and the upper grip piece toward each other in spite of the pressure of the spring.

The player, in repairing a depression in a putting green by the use of the repair tool of this invention, begins the work by lightly taking hold of the grip part and thrusting the inserting claw parts into the ground surface around the outer periphery of the depression in the putting green to be repaired while continuously standing. With the inserting claw parts kept thrust in the ground, the player strengthens his hold of the grip part so as to lower the upper grip part toward the lower grip part by overcoming the pressure of the spring, with the result that the inserting claw parts thrust into the ground surface by the slide engaging member being lowered relative to the tapered parts will be evenly moved toward the center of the depression in the putting green and the inner wall surfaces of the evenly moved inserting claw parts will gather the earth surrounding the depression in the putting green to the central part of the depression without cutting the roots of the turf grasses. In the ensuant state of the scene (in which the inserting claw parts have been advanced toward the center), the player pulls the strongly held grip part upward till the inserting claw parts are extracted from the ground and then relaxes his hold of the grip part extracted from the ground, with the result that the slide engaging member will be elevated by the pressure of the spring to a position parted from the tapered parts, the inserting claw parts will be moved backward to their original positions, and the earth gathered toward the center of the depression in the putting green will be left in a heaped-up state. The player turns the repair took upside down and depresses the flat part of the upper grip piece on the earth gathered to the center of the depression in the putting green and left in the piled-up state, with the result that the pile of the earth will be flattened to complete the repair.

According to the repair tool of claim 2 which has the lower terminal parts of the inserting claw parts bent inward, the function which the inserting claw parts moved toward the center of the depression in the putting green fulfills in gathering the earth around the depression toward the center thereof and piling it up can be further enhanced.

According to the repair tool of claim 3 which has an engaging stepped parts project from the outer walls of the split projecting pieces at the level of the boundary between the inserting claw parts and the tapered parts, it is made possible to set the depth to which the inserting claw parts are thrust into the ground surface, prevent the inserting claw parts from being thrust to an unduly great depth, and set the limit of the slide of the slide engaging member relative to the tapered parts.

DESCRIPTION OF EMBODIMENTS OF THE INVENTION

Figure 1:
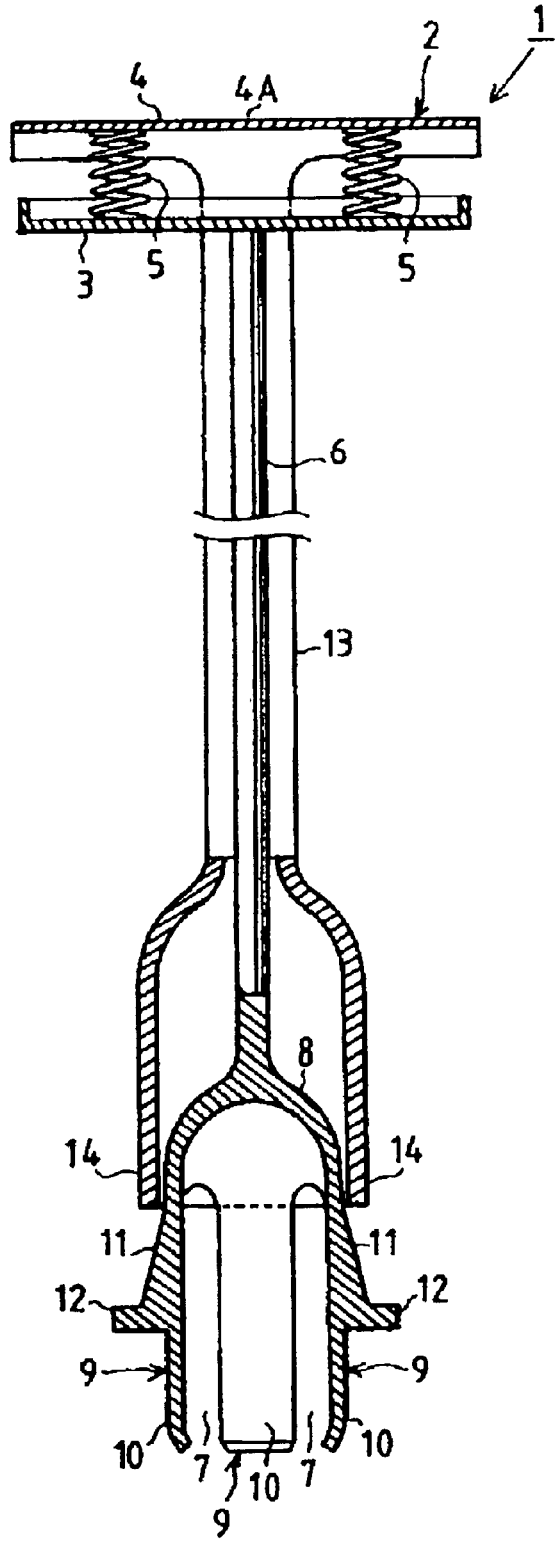
FIG. 1 is a longitudinal front view of this invention.
Figure 2:
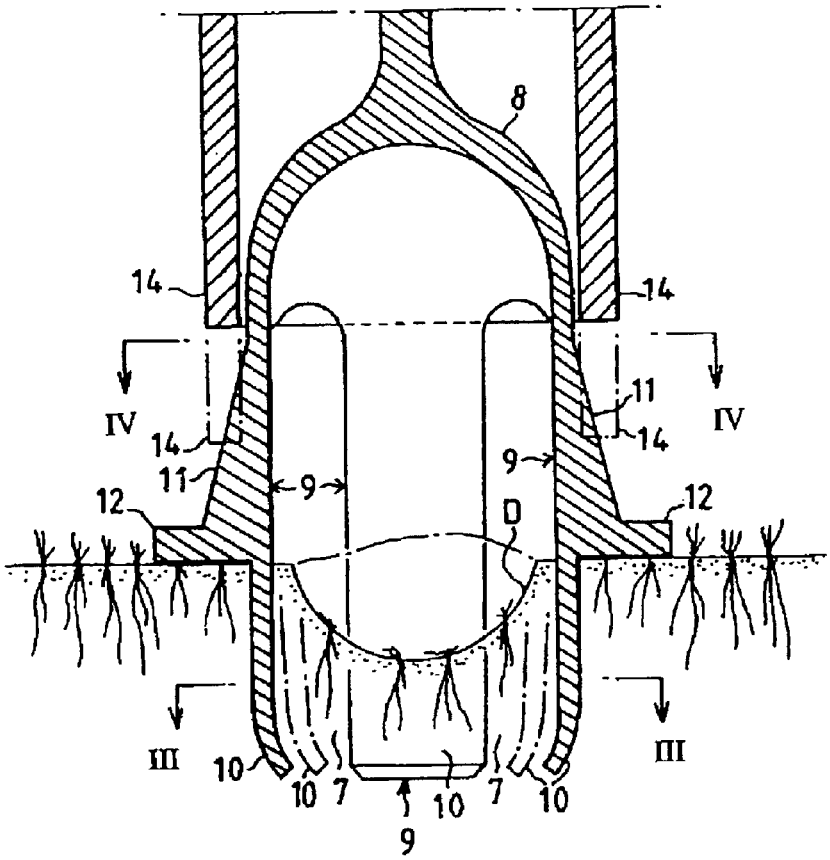
FIG. 2 is a magnified longitudinal front view of the essential part illustrating the state of use of this invention.
Figure 3:
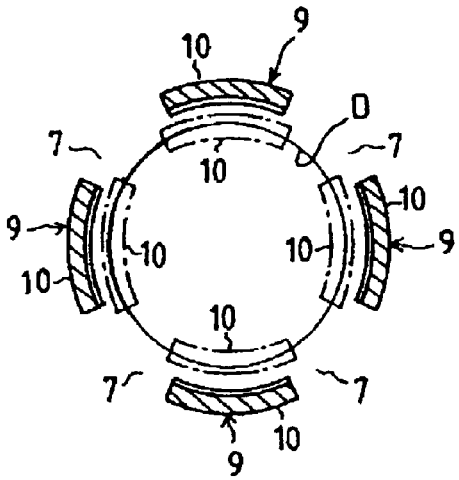
FIG. 3 is a cross-sectional plan view taken through FIG. 2 along the arrow line III—III.
Figure 4:
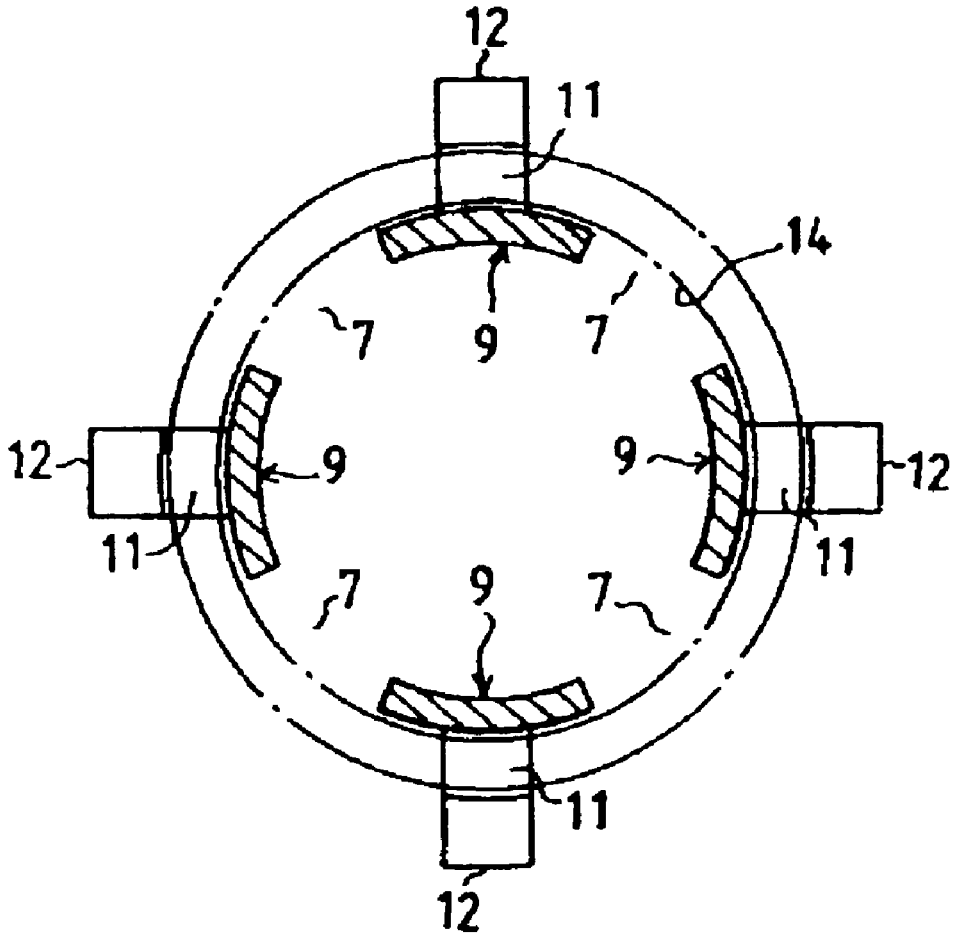
FIG. 4 is a cross-sectional plan view taken through FIG. 2 along the arrow line IV—IV.

Now, the mode of embodying this invention will be described below with reference to the drawings annexed hereto. FIG. 1 is a longitudinal front view of this invention, FIG. 2 is a magnified longitudinal front view of the essential part illustrating the state of use of this invention, FIG. 3 is a cross-sectional plan view taken through FIG. 2 along the arrow line III—III, and FIG. 4 is a cross-sectional plan view taken through FIG. 2 along the arrow line IV—IV.

In the diagrams, reference numeral 1 denotes a repair tool. This repair tool 1 is provided with a grip part 2 of which the player takes hold. This grip part 2 is formed by mounting a lower grip piece 3 and an upper grip piece 4 expandably in the vertical direction through the medium of spring bodies 5 consisting of a plurality of coil springs. On the upper surface side of the upper grip piece 4, a flat part 4*a* adapted to flatten evenly the earth gathered and piled up as specifically described herein below is formed.

In the central part of the lower terminal of the lower grip piece 3 of the grip part, a rod 6 is fixed in a longitudinally disposed state. This rod 6 is provided at the lower terminal thereof with a plurality (four in the illustrated example) of split projecting pieces 9 ramified downward from the basal terminal part 8 through the medium of oblong split grooves 7. The plurality of split projecting pieces 9 are disposed to encompass the outer periphery of a depression D formed in a putting green by a golf ball as illustrated in FIG. 3. About one half on the lower terminal side of the split projecting pieces 9 constitute themselves inserting claw parts 10 capable of being inserted into the ground surface. The lower terminal parts of these inserting claw parts 10 are slight curved inward.

On the outer wall sides of the split projecting pieces 9, tapered parts 11 are respectively formed at the positions above the inserting claw parts 10. These tapered parts 11 are made to form inclined surfaces allowed to assume a gradual radial expansion in the direction of decreasing height. Further, on the outer wall sides of the split projecting pieces 9, engaging stepped parts 12 are formed as projected outward at the level of the boundary between the inserting claw parts 10 and the tapered parts 11.

The main component members of this repair tool do not need to be particularly discriminated on account of the kind of material used heretofore but may be formed of such metal as aluminum or synthetic resin. The split projecting pieces 9 mentioned above are formed of a metallic material or a plastic material having elasticity such that the inserting claw parts 10 lying on the lower terminal sides thereof may be deformed inward as shown by an alternate long and short dash line in FIG. 2 and FIG. 3 when a depressing force is applied from outside in the direction of the tapered parts 11 and they are allowed to resume their original shape when the depressing force is released.

The length from the grip part 2 to the inserting claw parts 10 is set at such a dimension as fits the player's movement of taking hole of the grip part 2 and inserting the inserting claw parts 10 into the ground surface while continuously standing.

Further, a connecting piece 13 is fixed in a vertically disposed state to the upper grip piece 4 of the grip part 2. This connecting piece 13 is provided on the lower terminal thereof with an annular slide engaging member 14 which is adapted to contact evenly the tapered parts 11 from outside and move freely in the vertical direction. By forcing the lower grip piece 3 and the upper grip piece 4 toward each other enough to overcome the pressure of spring of the spring bodies 5 mentioned above, it is made possible to move vertically the slide engaging member 13 and the tapered parts 11 relative to each other and move the tapered parts 11 and the inserting claw parts 10 toward and away from the central part of the depression D in the putting green (shown with a solid line and an alternate long and short dash line in FIG. 2 and FIG. 3).

The player, in repairing a depression in a putting green by the use of this repair tool, begins the work by lightly taking hold of the grip part 2 and thrusting the inserting claw parts 10 into the ground surface around the outer periphery of the depression D in the putting green to be repaired (shown with a solid line in FIG. 2 and FIG. 3) while continuously standing. With the inserting claw parts kept thrust in the ground, the player strengthens his hold of the grip part 2 so as to lower the upper grip part 4 toward the lower grip part 3 by overcoming the pressure of the spring bodies 5, with the result that the inserting claw parts 10 thrust into the ground surface by the slide engaging member 14 being lowered relative to the tapered parts 11 as shown with an alternate long and short dash line in FIG. 2 will be evenly moved toward the center of the depression D in the putting green (shown with an alternate long and short dash line in FIG. 2 and FIG. 3) and the inner wall surfaces of the evenly moved inserting claw parts 10 will gather the earth surrounding the depression D in the putting green to the central part of the depression D without cutting the roots of the turf grasses. In the ensuant state of the scene (in which the inserting claw parts 10 have been advanced toward the center), the player pulls the strongly held grip part 2 upward till the inserting claw parts 10 are extracted from the ground and then relaxes his hold of the grip part 2 extracted from the ground, with the result that the slide engaging member 14 will be elevated by the pressure of the spring bodies 5 to a position parted from the tapered parts 11, the inserting claw parts 10 will be moved backward to their original positions, and the earth gathered toward the center of the depression D in the putting green will be left in a heaped-up state as shown with an alternate long and short dash line in FIG. 2. The player turns the repair took upside down and depresses the flat part 4A of the upper grip piece 4 on the earth gathered to the center of the depression D in the putting green and left in the piled-up state, with the result that the pile of the earth will be flattened to complete the repair.

According to the repair tool of this invention for a depression in a putting green, even an unaccustomed player having inflicted a depression with his golf ball on the putting green is enabled to gather the earth surrounding the depression toward the center thereof by using the tool just once and fulfill this repair easily while continuously standing without doing any harm to the roots of the turf grasses.

What is claimed is:

1. A repair tool for repairing a depression formed by a golf ball in a putting green on a golf course, which repair tool comprising a grip part having an lower grip piece and an upper grip piece mounted expandably in a vertical direction through spring bodies, a plurality of split projecting pieces ramified downward through oblong split grooves from a basal terminal part of a rod vertically disposed downward from the lower grip piece of the grip part, the plurality of split projecting pieces being so disposed as to encompass an outer periphery of the depression in the putting green, lower terminal sides of the split projecting pieces being so adapted as to serve as inserting claw parts capable of being inserted into a ground surface, tapered parts formed of outer wall sides of the split projecting pieces above positions of the inserting claw parts and adapted to impart a gradual radial expansion to inclined surfaces thereof in a direction of decreasing height, the split projecting pieces being endowed with elasticity such that the inserting claw parts on the lower terminal sides thereof are deformed inward when an external depressing force is applied to the tapered parts and they are allowed to resume their former shape when the depressing force is released, an annular slide engaging member formed at a lower terminal of a connecting rod vertically disposed downward from the upper grip piece of the grip part and adapted to contact uniformly outer sides of the tapered parts and produce a free vertical motion, and the slide engaging member being vertically moved relative to the tapered parts and the inserting claw parts being moved toward and away from a central part of the depression in the putting green by pressing the lower grip piece and the upper grip piece toward each other in spite of pressure of the spring bodies.

2. The repair tool according to claim 1, wherein the lower terminal parts of said inserting claw parts are bent inwardly.

3. The repair tool according to claim 1, which further comprises engaging stepped parts projected from the outer wall sides of said split projecting pieces at a level of a boundary between said inserting claw parts and said tapered parts.

* * * * *